US006880332B2

(12) United States Patent
Pfaff et al.

(10) Patent No.: US 6,880,332 B2
(45) Date of Patent: Apr. 19, 2005

(54) METHOD OF SELECTING A HYDRAULIC METERING MODE FOR A FUNCTION OF A VELOCITY BASED CONTROL SYSTEM

(75) Inventors: Joseph L. Pfaff, Wauwatosa, WI (US); Keith A. Tabor, Richfield, WI (US)

(73) Assignee: HUSCO International, Inc., Waukeska, WI (US)

( * ) Notice: Subject to any disclaimer, the term of this patent is extended or adjusted under 35 U.S.C. 154(b) by 191 days.

(21) Appl. No.: 10/254,397

(22) Filed: Sep. 25, 2002

(65) Prior Publication Data

US 2004/0055454 A1 Mar. 25, 2004

(51) Int. Cl.[7] ..... F15B 13/04; F16D 31/02

(52) U.S. Cl. ..... 60/422; 60/460; 91/361; 91/446; 91/454

(58) Field of Search ..... 60/422, 433, 459, 60/454, 460, 466, 494; 91/361, 364, 444, 446, 454, 455, 456, 457, 459

(56) References Cited

U.S. PATENT DOCUMENTS

| | | | | |
|---|---|---|---|---|
| 3,954,046 A | | 5/1976 | Stillhard | |
| 4,061,155 A | | 12/1977 | Sopha | |
| 4,250,794 A | | 2/1981 | Haak et al. | |
| 4,437,385 A | | 3/1984 | Kramer et al. | |
| 5,201,177 A | | 4/1993 | Kim | |
| 5,249,140 A | | 9/1993 | Kessler | |
| 5,490,384 A | | 2/1996 | Lunzman | |
| 5,666,806 A | | 9/1997 | Dietz | |
| 5,701,793 A | | 12/1997 | Gardner et al. | |
| 5,784,945 A | * | 7/1998 | Krone et al. | 91/459 |
| 5,878,647 A | | 3/1999 | Wilke et al. | |
| 5,947,140 A | | 9/1999 | Aardema et al. | |
| 5,960,695 A | * | 10/1999 | Aardema et al. | 91/454 |
| 6,282,891 B1 | | 9/2001 | Rockwood | |
| 6,467,264 B1 | * | 10/2002 | Stephenson et al. | 91/454 |
| 6,575,484 B1 | * | 6/2003 | Rogala et al. | 280/124.158 |

OTHER PUBLICATIONS

Arne Jansson, et al., "Separate Controls of Meter–in and Meter–out Orifices in Mobile Hyraulic Systems," SAE Technical Papers Series, Sep. 1999, pp. 1–7, SAE International, Warrendale, PA.

* cited by examiner

*Primary Examiner*—Thomas E. Lazo
(74) *Attorney, Agent, or Firm*—George E. Haas; Quarles & Brady LLP

(57) ABSTRACT

The flow of fluid to a hydraulic actuator is controlled by a valve assembly which operates in different metering modes at various points in time. The metering mode to use in selected in response to the hydraulic load that acts on the valve associated with the hydraulic actuator. Specifically the load is determined and then compared to threshold levels associated with the different metering modes to choose the metering mode for use a given point in time.

50 Claims, 3 Drawing Sheets

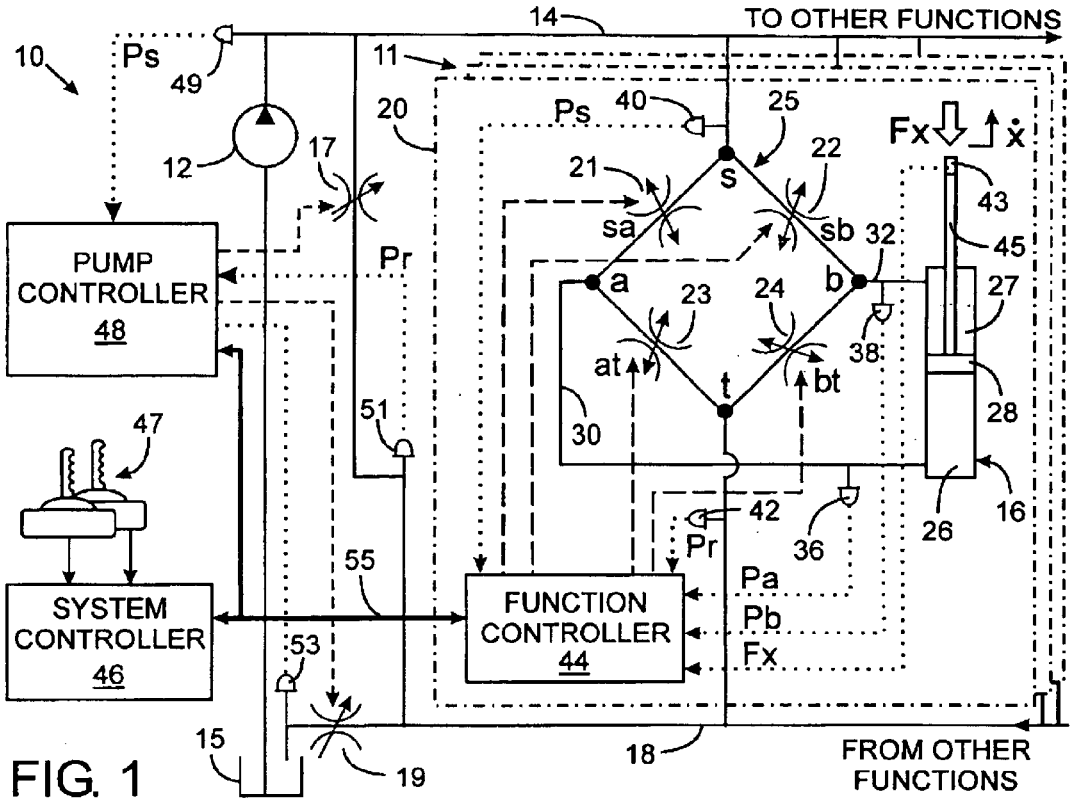
FIG. 1
FIG. 2
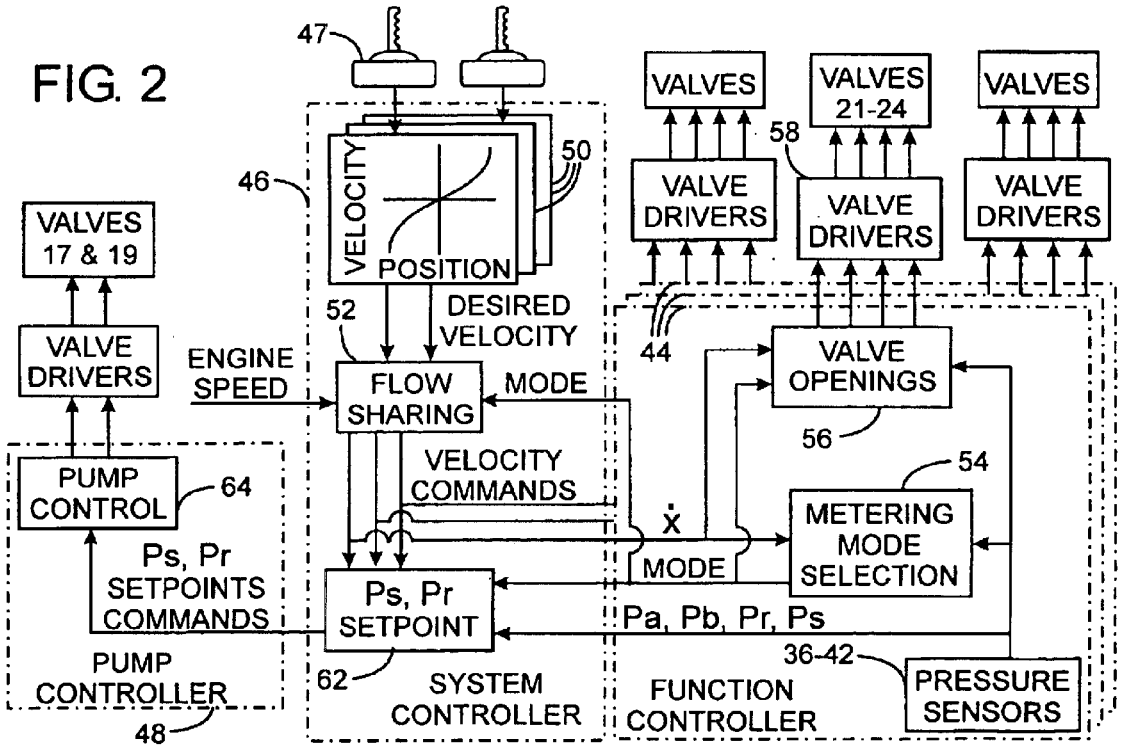

RETRACTION CONTROL

METHOD OF SELECTING A HYDRAULIC METERING MODE FOR A FUNCTION OF A VELOCITY BASED CONTROL SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to electrically controlled hydraulic systems for operating machinery, and in particular to determining in which one of a plurality of hydraulic fluid metering modes the system should operate at any given time.

2. Description of the Related Art

A wide variety of machines have moveable members which are operated by an hydraulic actuator, such as a cylinder and piston arrangement, that is controlled by a hydraulic valve. Traditionally the hydraulic valve was manually operated by the machine operator. There is a present trend away from manually operated hydraulic valves toward electrical controls and the use of solenoid operated valves. This type of control simplifies the hydraulic plumbing as the control valves do not have to be located near an operator station, but can be located adjacent the actuator being controlled. This change in technology also facilitates sophisticated computerized control of the machine functions.

Application of pressurized hydraulic fluid from a pump to the actuator can be controlled by a proportional solenoid operated spool valve that is well known for controlling the flow of hydraulic fluid. Such a valve employs an electromagnetic coil which moves an armature connected to the spool that controls the flow of fluid through the valve. The amount that the valve opens is directly related to the magnitude of electric current applied to the electromagnetic coil, thereby enabling proportional control of the hydraulic fluid flow. Either the armature or the spool is spring loaded to close the valve when electric current is removed from the solenoid coil. Alternatively a second electromagnetic coil and armature is provided to move the spool in the opposite direction.

When an operator desires to move a member on the machine a joystick is operated to produce an electrical signal indicative of the direction and desired rate at which the corresponding hydraulic actuator is to move. The faster the actuator is desired to move the farther the joystick is moved from its neutral position. A control circuit receives a joystick signal and responds by producing a signal to open the associated valve. A solenoid moves the spool valve to supply pressurized fluid through an inlet orifice to the cylinder chamber on one side of the piston and to allow fluid being forced from the opposite cylinder chamber to drain through an outlet orifice to a reservoir, or tank. A hydromechanical pressure compensator maintains a nominal pressure (margin) across the inlet orifice portion of the spool valve. By varying the degree to which the inlet orifice is opened (i.e. by changing its valve coefficient), the rate of flow into the cylinder chamber can be varied, thereby moving the piston at proportionally different speeds. A given amount of electric current applied to the valve's solenoid achieves the desired inlet orifice valve coefficient. Thus prior control algorithms were based primarily on inlet orifice metering using an external hydromechanical pressure compensator.

Recently a set of proportional solenoid operated pilot valves has been developed to control fluid flow to and from the chambers of a cylinder, as described in U.S. Pat. No. 5,878,647. One pair of valves controls the flow of fluid from a supply line into the cylinder chambers and the another pair of valves controls the flow of fluid from the cylinder chambers into a tank return line. By selectively opening the proper valve in each pair, the cylinder can extend or retract its piston. These modes of metering fluid to and from the cylinder are referred to as "powered extension" and "powered retraction."

Hydraulic systems also employ regeneration modes of operation in which fluid being drained from one cylinder chamber is fed back through the valve assembly to supply the other cylinder chamber. The pair of valves connected to the supply line may be opened to connect the cylinder chambers in the "high side regeneration" metering mode or the pair of valves connected to the return line may be opened to connect the cylinder chambers in the "low side regeneration" metering mode. Heretofore, the mode of operation typically was selected manually by the machine operator. However, it is desirable to provide automatic mode selection.

SUMMARY OF THE INVENTION

A typical hydraulic system has a supply line that carries fluid from a source, a return line which carries fluid back to a tank, and a hydraulic actuator, such as a piston and cylinder arrangement coupled to the supply line and the return line by a plurality of valves which serves as a flow control mechanism. However, the concepts of the present method can be used with other hydraulic system configurations. The plurality of valves are selectively operated to control the flow of fluid to the hydraulic actuator in a number of metering modes. A given hydraulic system may employ a combination of two or more of the following metering modes: powered retraction, powered extension, high side regeneration retraction, high side regeneration extension, low side regeneration retraction, and low side regeneration extension.

The process for selecting which one of the employed plurality of metering modes to use at any point in time involves determining a parameter value which denotes an amount of force acting on the actuator. Any one of a number of techniques can be used in making that determination, such as directly measuring the force exerted on the actuator or deriving the load from a measurement of pressure in the actuator, for example.

The determined parameter value then is used to choose a metering mode from the plurality of available modes. In a preferred embodiment of the present method, one or more threshold levels are defined for each available metering mode and the relationships between the parameter value and those threshold levels determine a metering mode to use at any given point in time.

The flow control mechanism then is operated in the selected metering mode to control flow of fluid to the hydraulic actuator.

BRIEF DESCRIPTION OF THE DRAWINGS

FIG. 1 is a schematic diagram of a hydraulic system incorporating the present invention;

FIG. 2 is a control diagram for the hydraulic system;

DETAILED DESCRIPTION OF THE INVENTION

Figure 3:
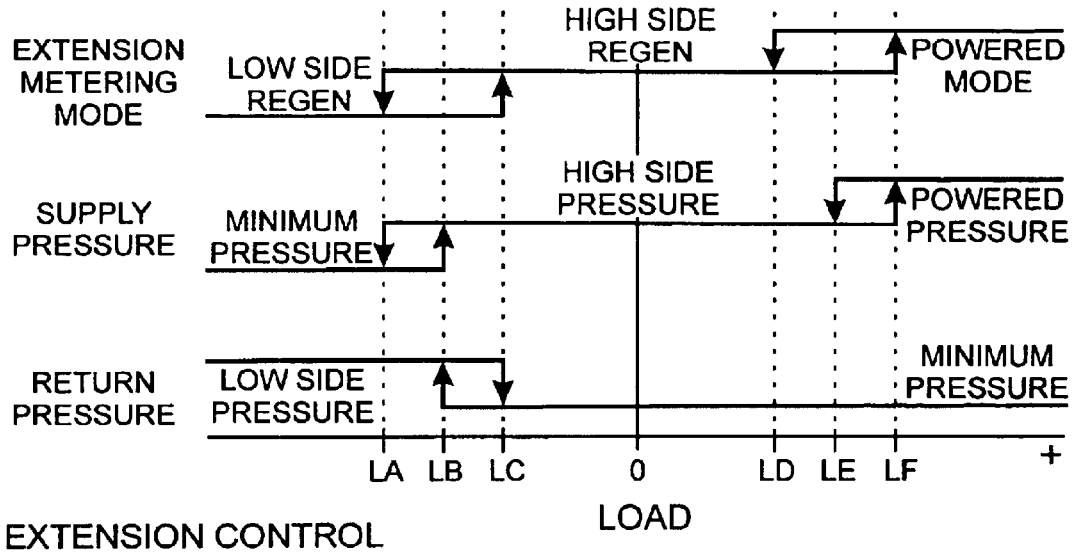
FIG. 3 is a diagram of the hydraulic system operation during piston rod extension which depicts relationships between the hydraulic load and metering mode transitions, and between the hydraulic load and control of fluid pressure in the supply and return lines in the system.

With initial reference to FIG. 1, a hydraulic system 10 of a machine is shown that has mechanical elements operated by hydraulically driven actuators, such as cylinder 16 or rotational motors. The hydraulic system 10 includes a positive displacement pump 12 that is driven by a motor or engine (not shown) to draw hydraulic fluid from a tank 15 and furnish the hydraulic fluid under pressure to a supply line 14. It should be understood that the novel techniques for selecting metering modes described herein also can be implemented on a hydraulic system that employs a variable displacement pump and other types of hydraulic actuators. The supply line 14 is connected to a tank return line 18 by an unloader valve 17 (such as a proportional pressure relief valve) and the tank return line 18 is connected by tank control valve 19 to the system tank 15.

The supply line 14 and the tank return line 18 are connected to a plurality of hydraulic functions on the machine on which the hydraulic system 10 is located. One of those functions 20 is illustrated in detail and other functions 11 have similar components. The hydraulic system 10 is of a distributed type in that the valves for each function and control circuitry for operating those valves can be located adjacent to the actuator for that function. For example, those components for controlling movement of the arm with respect to the boom of a backhoe are located at or near the arm cylinder or the junction between the boom and the arm.

In the given function 20, the supply line 14 is connected to node "s" of a valve assembly 25 which has a node "t" that is connected to the tank return line 18. The valve assembly 25 includes a node "a" that is connected by a first hydraulic conduit 30 to the head chamber 26 of the cylinder 16, and has another node "b" that is coupled by a second conduit 32 to a port of the rod chamber 27 of cylinder 16. Four electrohydraulic proportional valves 21, 22, 23, and 24 control the flow of hydraulic fluid between the nodes of the valve assembly 25 and thus control fluid flow to and from the cylinder 16. The first electrohydraulic proportional valve 21 is connected between nodes s and a, and is designated by the letters "sa". Thus the first electrohydraulic proportional valve 21 controls the flow of fluid between the supply line 14 and the head chamber 26 of the cylinder 16. The second electrohydraulic proportional valve 22, designated by the letters "sb", is connected between nodes "s" and "b" and can control fluid flow between the supply line 14 and the cylinder rod chamber 27. The third electrohydraulic proportional valve 23, designated by the letters "at", is connected between node "a" and node "t" and can control fluid flow between the head chamber 26 and the return line 18. The fourth electrohydraulic proportional valve 24, which is between nodes "b" and "t" and designated by the letters "bt", controls the flow from the rod chamber 27 to the return line 18.

The hydraulic components for the given function 20 also include two pressure sensors 36 and 38 which detect the pressures Pa and Pb within the head and rod chambers 26 and 27, respectively, of cylinder 16. Another pressure sensor 40 measures the pump supply pressure Ps at node "s", while pressure sensor 42 detects the tank return pressure Pr at node "t" of the function 20. The pressure sensors 36, 38, 40, and 42 should be placed as close to the valve assembly 25 as possible to prevent velocity errors due to conduit line losses. It should be understood that the various pressures measured by these sensors may be slightly different from the actual pressures at these points in the hydraulic system due to line losses between the sensor and those points. However the sensed pressures relate to and are representative of the actual pressures and accommodation can be made in the control methodology for such differences. Furthermore, all of these pressure sensors may not be present for all functions 11.

The pressure sensors 36, 38, 40 and 42 for the function 20 provide input signals to a function controller 44 which operates the four electrohydraulic proportional valves 21–24. The function controller 44 is a microcomputer based circuit which receives other input signals from a system controller 46, as will be described. A software program executed by the function controller 44 responds to those input signals by producing output signals that selectively open the four electrohydraulic proportional valves 21–24 by specific amounts to properly operate the cylinder 16.

The system controller 46 supervises the overall operation of the hydraulic system exchanging signals with the function controllers 44 and a pressure controller 48. The signals are exchanged among the three controllers 44, 46 and 48 over a communication network 55 using a conventional message protocol. The pressure controller 48 receives signals from a supply line pressure sensor 49 at the outlet of the pump, a return line pressure sensor 51, and a tank pressure sensor 53. In response to those pressure signals and commands from the system controller 46 the pressure controller 48 operates the tank control valve 19 and the unloader valve 17. However, if a variable displacement pump is used, the pressure controller 48 controls the pump.

With reference to FIG. 2, the control functions for the hydraulic system 10 are distributed among the different controllers 44, 46 and 48. A software program executed by the system controller 46 responds to input signals by producing commands for the function controllers 44. Specifically, the system controller 46 receives signals from several user operated joysticks 47 or similar input devices for the different hydraulic functions. Those input device signals are received by a separate mapping routine 50 for each function which converts the joystick position signal into a signal indicating a desired velocity for the associated hydraulic actuator being controlled. The mapping function can be linear or have other shapes as desired. For example, the first half of the travel range of the joystick from the neutral center position may map to the lower quartile of velocities, thus providing relatively fine control of the actuator at low velocity. In that case, the latter half of the joystick travel maps to the upper 75 percent range of the velocities. The mapping routine may be implemented by an arithmetic expression that is solved by the computer within system controller 46, or the mapping may be accomplished by a look-up table stored in the controller's memory. The output of the mapping routine 50 is a signal indicative of the velocity desired by the system user for the respective function.

In an ideal situation the desired velocity is used to control the hydraulic valves associated with this function. However, in many instances, the desired velocity may not be achievable in view of the simultaneous demands placed on the hydraulic system by other functions 11 of the machine. For example, the total quantity of hydraulic fluid flow demanded by all of the functions may exceed the maximum output of the pump 12, in which case, the control system must apportion the available quantity among all the functions demanding hydraulic fluid, and a given function may not be able to operate at the full desired velocity. Although that apportionment may not achieve the desired velocity of each function, it still maintains the velocity relationship among the actuators as indicated by the operator.

In order to determine whether sufficient flows exist from all sources to produce the desired function velocities, the flow sharing routine 52 receives indications as to the metering mode of all the active functions. The flow sharing routine then compares the total flows of fluid available to the total flows that would be required if every function operated at the desired velocity. The result of this processing is a set of velocity commands for the presently active functions. This determines the velocity at which the associated function will operate (a velocity command) and the commanded velocity may be less than the velocity desired by the machine operator, when insufficient fluid flows are available.

Each velocity command then is sent to the function controller 44 for the associated function 11 or 20. The function controller 44 determines how to operate the electrohydraulic proportional valves, such as valves 21–24, which control the hydraulic actuator for that function, in order to drive the hydraulic actuator at the commanded velocity. As a first step in that determination, the respective function controller 44 periodically executes metering mode selection routine 54 which identifies the optimum metering mode for the function at that particular point in time.

Consider metering modes for functions that operate a hydraulic cylinder and piston arrangement, such as cylinder 16 and piston 28 in FIG. 1. It is readily appreciated that hydraulic fluid must be supplied to the head chamber 26 to extend the piston rod 45 from the cylinder 16, and fluid must be supplied to the rod chamber 27 to retract the piston rod 45 into the cylinder. However, because the piston rod 45 occupies some of the volume of the rod chamber 27, that chamber requires less hydraulic fluid to produce an equal amount of motion of the piston than is required by the head chamber. As a consequence, the amounts of fluid flow required are determined based upon whether the actuator is being extended or retracted and by the metering mode used.

The fundamental metering modes in which fluid from the pump is supplied to one of the cylinder chambers 26 or 27 and drained to the return line from the other chamber are referred to as "powered metering modes", specifically "powered extension" and "powered retraction".

Hydraulic systems also employ "regeneration" metering modes in which fluid being drained from one cylinder chamber 26 or 27 is fed back through the valve assembly 25 to supply the other cylinder chamber. In a regeneration mode, the fluid can flow between the cylinder chambers through either the supply line node "s", referred to as "high side regeneration" or through the return line node "t" in "low side regeneration". It should be understood that in a regeneration retraction mode, when fluid is being forced from the head chamber 26 into the rod chamber 27, a greater volume of fluid is draining from the head chamber than is required in the smaller rod chamber. During the low side regeneration retraction mode, that excess fluid enters the return line 18 from which it continues to flow either to the tank 15 or to other functions 11 operating in a low side regeneration mode that require additional fluid.

Regeneration also can occur when the piston rod 45 is being extended from the cylinder 16, in which case an insufficient volume of fluid is exhausting from the smaller rod chamber 27 than is required to fill the head chamber 26. During an extension in the low side regeneration mode, the function has to receive additional fluid from the tank return line 18. That additional fluid either originates from another function, or from the pump 12 through the unloader valve 17. It should be understood that during low side regeneration extension, the tank control valve 19 is at least partially closed to restrict fluid in the return line 18 from flowing to the tank 15, so that fluid is supplied from another function 11 or indirectly from the pump 12. When the high side regeneration mode is used to extend the rod, the additional fluid comes from the pump 12.

In a first embodiment, the metering mode selection routine 54 utilizes the cylinder chamber pressures Pa and Pb of the function. In a second embodiment, the supply and return line pressures Ps and Pr are also used. From those pressure measurements, the algorithm of the metering mode selection routine determines whether then necessary pressure is available from the supply and/or return lines (14 and/or 18) to operate in each metering mode. An efficient mode then is chosen. Once selected, the metering mode is communicated to the system controller 46 and valve opening routine of the respective function controller 44.

Whether a particular metering mode is viable at a given point in time is determined based on the hydraulic load, L. In the preferred embodiment, the hydraulic load is calculated according to the expression $L=R*Pa-Pb$, where R is the ratio of the (hydraulic) cross sectional areas of the head and rod cylinder chambers 26 and 27 respectively. It should be noted that the hydraulic load varies not only with changes in the external force Fx exerted on the piston rod 45, but also with conduit flow losses and cylinder friction changes. Alternatively, the hydraulic load can be estimated by measuring the force Fx (e.g. by a load cell 43 on the piston rod) and using the expression $L=Fx/Ab$. However, in this case, conduit line losses and cylinder friction would be ignored and while that is acceptable in certain hydraulic systems, in other systems it may lead to less accurate metering mode transitions. As a consequence, the metering mode selection can be based on the value of a parameter which may be the hydraulic load or simply the external force Fx exerted on the actuator or a pressure in the system that results from that external force. With those alternatives in mind, the present method will be described in the context of using the hydraulic load as that parameter.

Although the present control method is being described in terms of controlling a cylinder and piston arrangement on which an external linear force acts, the methods described herein can be used to control a motor in which case the external force acting on the actuator would be expressed as a torque. Therefore, to simplify the description of the present invention, the term "force" used herein includes torque.

FIG. 3 graphically depicts operation of the hydraulic system to extend the piston rod from the cylinder. The relationships of the hydraulic load to several thresholds determine in which one of the three extension metering modes (powered, low side regeneration or high side regeneration) to operate. As will be described a similar set of thresholds as used to determined the metering mode while the piston is being retracted into the cylinder. The top graph in FIG. 3 denotes the metering mode selection. It should be noted that the mode selection incorporates hysteresis to reduce the possibility of the system toggling back and forth between two modes unnecessarily. The control algorithm employs six load thresholds designated LA through LF in ascending order. In the present example, the first three thresholds LA, LB, and LC are negative levels in order from most to least negative. The other three thresholds LD, LE, and LF are positive load levels. In a basic implementation of the mode selection algorithm, the six load thresholds are fixed values determined for the particular function. Alternatively as will be described later, dynamic thresholds can be used which vary depending upon operating conditions of the hydraulic function.

Figure 4:
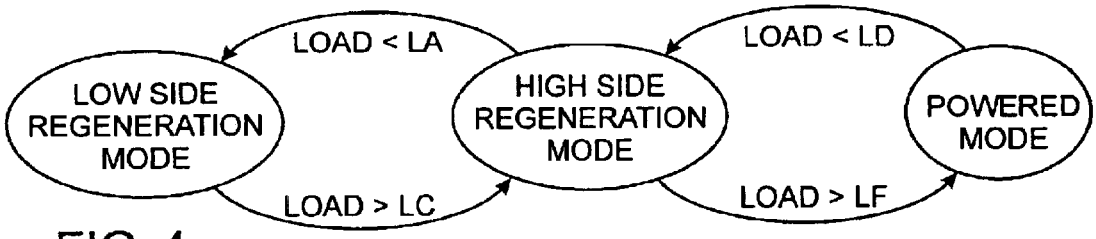
FIG. 4 is a state diagram of the extension metering modes for the hydraulic system.

With additional reference to the state diagram of FIG. 4 for rod extension, the function controller 44 selects the low side regeneration (regen) mode when the load is less than the most negative threshold level LA. From the low side regeneration mode, the controller makes a transition to the high side regeneration mode when the hydraulic load rises above the negative threshold level LC. If the load is above the most positive threshold level LF, a transition occurs from the high side regeneration to the powered mode. The operation remains in the powered mode until the hydraulic load decreases below the positive threshold level LD, at which point high side regeneration again is employed. A transition occurs from the high side regeneration mode to the low side regeneration mode when the load drops below the negative threshold level LA.

Referring again to FIG. 2, when a transition occurs, the new metering mode is communicated to the valve opening routine 56 executed by the function controller 44. The valve opening routine 56 responds to the mode, the velocity command, and pressures measured in the system by determining the amount that the respective valves 21–24 should be opened to achieve that commanded velocity in the selected metering mode.

The pressure Ps in the supply line 14 and the pressure Pr in the return line 18 also are controlled by the system and pressure controllers 46 and 48 based on the chosen metering mode and the measured system pressures. In order for a smooth transition to occur between metering modes, it is desirable that the respective one of the supply or return line 14 and 18, that is to furnish fluid flow to the function, be at the proper pressure level for the new metering mode prior to the transition. Thus the supply pressure and the return pressure are controlled in response to the hydraulic load before the corresponding metering mode transition occurs. In addition, the pressure controller 48 continues to maintain the proper pressures in the supply and return lines 14 and 18 after the metering mode transition.

The two lower graphs in FIG. 3 depict the pressure level changes for the supply line 14 and the return line 18, respectively. The pressure control is represented by the state diagrams in FIGS. 5 and 6, as well. The determination of the desired supply line pressure Ps and return line pressure Pr is implemented by the Ps and Pr setpoint routine 62 in the system controller 46. That routine 62 calculates the required setpoints for the supply and return line pressures for each machine function and then selects the highest of those setpoints for each line to use in controlling the respective pressure.

Figure 5:
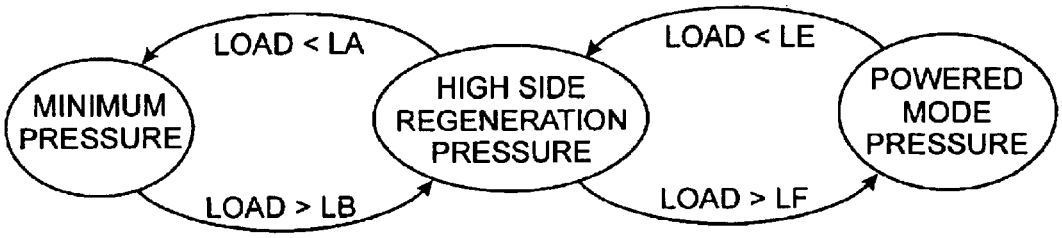
FIG. 5 is a state diagram representing control of the pressure in the supply line during an extension.
Figure 6:
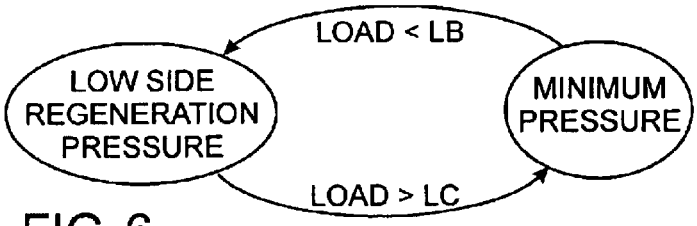
FIG. 6 is a state diagram representing control of the pressure in the return line during an extension.

Considering the determination of the required supply line pressure for one of the functions, it can be seen from FIGS. 3 and 5 that the function specifies a minimum pressure level (e.g. 20 bar) in the supply line 14 when operating in the low side regeneration mode. In that metering mode, the function does not require any fluid flow from the supply line 14 and thus, the supply line can be maintained at that minimum pressure level as far as this particular function is concerned. When the load in the low side regeneration mode increases above the threshold level LB, the supply line pressure Ps for this function increases to the pressure level required for the high side regeneration mode. This increase in pressure occurs before the load exceeds the threshold level LC at which a metering mode transition occurs to high side regeneration. As a result, the pressure in the supply line 14 will be at least at the level required by this function for high side regeneration when the mode transition occurs.

It should be understood that another function of the machine may be requiring an even higher supply line pressure, which will be selected by the system controller 46 and used by the pressure controller 48 to set that pressure level. However, as long as the pressure in the supply line is at least as great as that required for the present mode of operation of a given function, that function can operate properly. Thus, when the load exceeds the threshold level LB, the Ps, Pr setpoint function 62 utilizes the measured pressures Pa, Pb, and Pr received from the function controller 44 along with the commanded velocity $\dot{x}$ for this function to calculate a new supply line pressure required by this function.

While operating in the high side regeneration mode the load may increase above the threshold level LF, which results in a transition occurring to the powered extension mode of operation, as described previously. Since the pressure in the supply line, during an extension in the high side regeneration mode generally is greater than the pressure required in the powered extension mode given a constant load and speed requirement, a corresponding change in the supply line pressure does not occur until load level LF is exceeded. At that point, the supply line pressure decreases to the level required for the powered extension mode.

In the powered extension mode if the load level decreases below the threshold level LE, the supply line pressure Ps is increased to the level required for the high side regeneration mode. Therefore, the pressure will be preset to the requisite level should the hydraulic load continue to decrease below threshold level LD, at which point the transition occurs to the high side regeneration mode.

If the hydraulic load in the high side regeneration mode drops below the threshold level LA, a transition occurs to the low side regeneration mode. This load drop also causes the supply line pressure Ps for this function to be set at the minimum pressure level as fluid no longer is required from the supply line 14 in the low side regeneration mode.

The pressure in the return line 18 is controlled in a similar manner based on the hydraulic load associated with cylinder 16. When the given function 20 is not in the low side regeneration mode, the pressure level Pr for the return line 18 required by the function is set to a minimum pressure (e.g. 20 bar), as designated in FIG. 3. However, if the hydraulic load decreases below the negative threshold level LB, the required return line pressure increases to the level for the low side regeneration mode. Thus, the pressure in the return line 18 will be at the proper level in the event that the hydraulic load continues to decrease below the threshold level LA at which point a transition to the low side regeneration occurs. The return line pressure Pr for this function remains at the low side regeneration level until the hydraulic load increases above the threshold level LC at which time the required return line pressure decreases to the minimum pressure level as fluid is not required from the return line 18 in the other modes.

Figure 7:
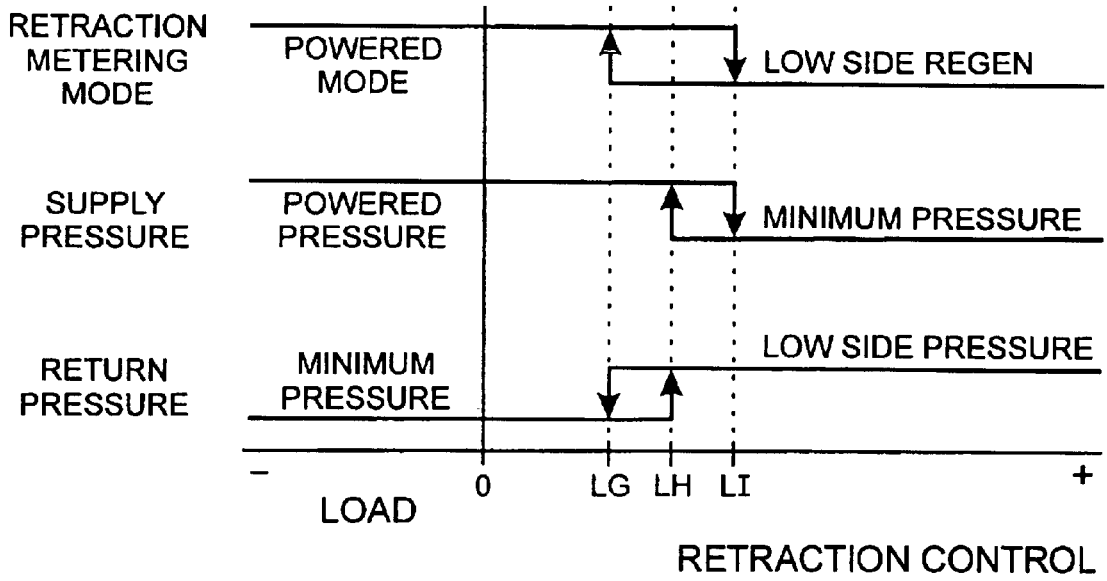
FIG. 7 is a diagram similar to FIG. 3, but for piston rod retraction.

FIG. 7 is a graphical depiction of operation of the hydraulic system to retract the piston rod. Here another pair of load thresholds LG and LI are employed to select between the low side regeneration and powered metering modes. To retract the piston, the Low Side Regeneration mode is generally preferred over Powered Retraction since the regeneration mode does not require direct supply line flow. An intermediate load threshold LH is use to change the pressures in the supply and return lines. The supply line pressure increases to the level required for the powered mode and the return line pressure increases to the low side regeneration pressure prior to the respective transitions into those modes. Some pressure is required on the return line to prevent cavitation on the inlet during a retraction in the low side regen mode. Although high side regeneration is not used in the exemplary system to retract the piston rod, it could be added to the control algorithm in FIG. 7.

The metering mode and pressure control described thus far utilize fixed threshold levels LA–LI. The efficiency of the hydraulic system can be enhanced by employing instantaneous operating parameters of the hydraulic function to dynamically determine when transitions of the metering mode and the pressure in the supply and return lines should occur. Also, the following dynamic threshold equations could be used to select the fixed threshold levels given planned metering mode supply and return transition pressures.

The driving pressure, Peq, required to produce movement of the piston rod 45 for the various metering modes is given by the equations in Table 1.

TABLE 1

| METERING MODE DRIVING PRESSURES | |
|---|---|
| Low Side Regeneration Extension | Peq = (R * Pr − Pr) − (R * Pa − Pb) |
| High Side Regeneration Extension | Peq = (R * Ps − Ps) − (R * Pa − Pb) |
| Powered Extension | Peq = (R * Ps − Pr) − (R * Pa − Pb) |
| Low Side Regeneration Retraction | Peq = (Pr − R * Pr) + (R * Pa − Pb) |
| Powered Retraction | Peq = (Ps − R * Pr) + (R * Pa − Pb) |

If the driving pressure is zero, i.e. Peq=0, the forces on the cylinder are balanced by the hydraulic pressures and no movement will occur. However, to overcome cylinder friction, valve losses, and conduit line losses, Peq must meet or exceed a total margin constant, K (e.g. 30 bar). Therefore, if the driving pressure meets or exceeds this total margin constant (i.e. Peq≧K), the piston rod 45 will move in the direction given by the velocity command when the two valves are opened. Using that condition and substituting the hydraulic load (R*Pa−Pb) into each equation in Table 1 produces the load to pressure relationships in Table 2, thereby defining a load range for use in determining whether a given metering mode is viable at a given point in time.

TABLE 2

| METERING MODE OPERATING RANGES | |
|---|---|
| Low Side Regeneration Extension | L ≦ R * Pr − Pr − K |
| High Side Regeneration Extension | L ≦ R * Ps − Ps − K |
| Powered Extension | L ≦ R * Ps − Pr − K |

TABLE 2-continued

| METERING MODE OPERATING RANGES | |
|---|---|
| Low Side Regeneration Retraction | L ≧ R * Pr − Pr + K |
| Powered Retraction | L ≧ −Ps + R * Pr + K |

The actual metering mode transition points are given in Table 3. The metering mode transitions are functions of the hydraulic load and one or both of the supply line pressure Ps and the return line pressure Pr depending upon the metering mode (which implicitly includes the direction of the desired movement). It should be apparent from the relationships in Table 2 that a mode transition can be avoided by varying the supply line pressure, the return line pressure, or both as the load changes in order to stay on the same side of the load threshold.

Because more than one of the expressions in Table 2 may be true at any point in time, multiple valid metering modes can occur simultaneously with this control algorithm. Which one of the valid modes is selected is based on the one that provides the most efficient and economical operation while also obtaining the desired velocity. Specifically, for example, during a piston rod extension, the Low Side Regeneration Extension mode may have the highest priority assuming that fluid is available in the return line, because in this case flow is not required directly from the supply line. After that the High Side Regeneration Extension may be preferred as that requires the next least amount of fluid from the supply line 14, and the Powered Extension mode has the lowest priority. The metering mode operating ranges given in Table 2 must be satisfied but the metering mode transition points can be selected differently in different situations to met different design tradeoffs.

The mode transition threshold levels LA, LC, LD, LF, LG, and LI; and the intermediate threshold levels LB, LE, and LH at which the supply and return line pressures change are determined by the expressions:

TABLE 3

| METERING MODE TRANSITION POINTS |
|---|
| LA = R * Pr − Pr − N |
| LB = R * Pr − Pr − M |
| LC = R * Pr − Pr − K |
| LD = R * Ps − Ps − N |
| LE = R * Ps − Ps − M |
| LF = R * Ps − Ps − K |
| LG = R * Pr − Pr + K |
| LH = R * Pr − Pr + M |
| LI = R * Pr − Pr + N |

where M is a constant (e.g. 45 bar) chosen so that the pressure change will occur prior to the metering mode transition, N is a constant (e.g. 60 bar) chosen to provide a desired degree of hysteresis, and K≦M≦N. The selection of these two constants depends upon how fast the pump can respond and how fast the hydraulic load changes.

As mentioned above, the metering mode, the pressure measurements, and the velocity command are used by a valve opening routine 56 in the function controller 44 to operate the electrohydraulic proportional valves 21–24 in a manner that achieves the commanded velocity of the piston rod 45. In each metering mode, two of the valves in assembly 25 are active, or open. The metering mode defines which pair of valves will be opened. The valve opening routine 56 determines the amount that each of the selected valves is to be opened. This results in a set of four output signals which the function controller sends to a set of valve drivers 58 which produce electric current levels for operating the selected ones of valves 21–24.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A method of controlling flow of fluid to an actuator in a hydraulic system that has a plurality of metering modes, said method comprising:

determining a parameter value that denotes an amount of force acting on the actuator;

measuring pressure in a conduit through which fluid is supplied to the actuator thereby producing a pressure measurement;

selecting a chosen metering mode from the plurality of metering modes in response to a relationship between the parameter value and the pressure measurement wherein such selecting chooses a source of hydraulic fluid for the actuator from a plurality of sources; and operating a flow control device to control flow of fluid to the actuator in response to the chosen metering mode.

2. The method as recited in claim 1 wherein the plurality of metering modes are selected from a group consisting essentially of powered retraction, powered extension, high side regeneration retraction, high side regeneration extension, low side regeneration retraction, and low side regeneration extension.

3. The method as recited in claim 1 further comprising:

measuring pressure in a supply line coupling the actuator to a pump in the hydraulic system, thereby producing a first pressure measurement;

measuring pressure in a return line coupling the actuator to a tank in the hydraulic system, thereby producing a second pressure measurement; and wherein the chosen metering mode is selected in response to a relationship between the parameter value and both the first pressure measurement and the second pressure measurement.

4. The method as recited in claim 1 further comprising:

measuring pressure in one of a supply line coupling the actuator to a pump in the hydraulic system and a return line coupling the actuator to a tank in the hydraulic system, thereby producing a pressure measurement; and wherein the chosen metering mode is selected in response to a relationship between the parameter value and the pressure measurement.

5. The method as recited in claim 1 wherein selecting a chosen metering mode comprises:

transitioning to a first metering mode from a second metering mode when the parameter value is less than a first threshold level; and transitioning to the second metering mode from the first metering mode when the parameter value is greater than a second threshold level, which is greater than the first threshold level.

6. The method as recited in claim 5 further comprising transitioning to a third metering mode from the second metering mode when the parameter value is greater than a third threshold level which is greater that the second threshold level; and transitioning to the second metering mode from the third metering mode when the parameter value is less than a fourth threshold level, which is less than the third threshold level and greater that the second threshold level.

7. The method as recited in claim 6 wherein:

the first metering mode is a low side regeneration metering mode;

the second metering mode is a high side regeneration metering mode; and the third metering mode is a powered metering mode.

8. The method as recited in claim 1 wherein determining a parameter value comprises deriving the parameter value from a pressure level in the actuator.

9. The method as recited in claim 1 wherein the actuator is a cylinder with two chambers each having a cross sectional area, and the parameter value is given by the expression R*Pa−Pb, where R is a ratio of the cross sectional areas of the two chambers, Pa is the pressure level in one chamber, and Pb is the pressure level in the other chamber.

10. The method as recited in claim 1 further comprising, in response to the parameter value, controlling pressure of fluid furnished to the actuator.

11. The method as recited in claim 1 wherein selecting a chosen metering mode also is in response to a direction of desired motion of the actuator.

12. The method as recited in claim 1 wherein the plurality of metering modes includes both powered and regeneration modes.

13. A method of controlling flow of fluid to an actuator in a hydraulic system that has a plurality of metering modes, said method comprising:

defining a threshold level for each of the plurality of metering modes;

determining a parameter value that denotes an amount of force acting on the actuator;

selecting a chosen metering mode from the plurality of metering modes in response to relationships between the parameter value and the defined threshold levels, wherein such selecting chooses a source of hydraulic fluid for the actuator from a plurality of sources; and operating a flow control device to control flow of fluid to the actuator in response to the chosen metering mode.

14. The method as recited in claim 13 wherein defining a threshold level for each of the plurality of metering modes comprises calculating a threshold level for each metering mode based on pressure of the fluid in the hydraulic system.

15. The method as recited in claim 13 wherein a threshold level for one of the plurality of metering modes is defined based on pressure of fluid being supplied to the actuator from a source.

16. The method as recited in claim 13 wherein a threshold level for one of the plurality of metering modes is defined based on pressure in a conduit extending between the actuator and a tank of the hydraulic system.

17. The method as recited in claim 13 wherein a threshold level for one of the plurality of metering modes is defined based on pressure of fluid being supplied to the actuator from a source and pressure in a conduit extending between the actuator and a tank of the hydraulic system.

18. The method as recited in claim 13 wherein a threshold level for each of the plurality of metering modes is defined based on pressure of the fluid in the hydraulic system and a characteristic of the actuator.

19. A method of controlling flow of fluid to an actuator in a hydraulic system that has a plurality of metering modes, said method comprising:

determining a parameter value that denotes an amount of force acting on the actuator;

selecting a chosen metering mode from the plurality of metering modes in response to the parameter value, wherein such selecting chooses a source of hydraulic fluid for the actuator from a plurality of sources;

operating a flow control device to control flow of fluid to the actuator in response to the chosen metering mode; and controlling pressure of fluid, which is furnished to the actuator, in response to a relationship between the parameter value and a threshold that is calculated based on a pressure level in the hydraulic system.

20. The method as recited in claim 19 further comprising changing pressure in a conduit of the hydraulic system in response to the parameter value being greater than a predefined threshold.

21. The method as recited in claim 19 further comprising changing pressure in a conduit of the hydraulic system in response to the parameter value being less than a predefined threshold.

22. A method of controlling flow of fluid to an actuator in a hydraulic system that has a plurality of metering modes, said method comprising:

determining a hydraulic load which varies with the force acting on the hydraulic actuator;

calculating a first threshold level based on pressure of the fluid in the hydraulic system;

selecting a first metering mode when the hydraulic load is less than the first threshold level;

selecting a second metering mode when the hydraulic load is greater than the first threshold level; and operating a flow control device to control flow of fluid to the actuator in response to which one of the plurality of metering modes was selected.

23. The method as recited in claim 22 wherein determining a hydraulic load comprises deriving the hydraulic load from a pressure level in the hydraulic actuator.

24. The method as recited in claim 22 wherein the hydraulic actuator is a cylinder with two chambers each having a cross sectional area, and the hydraulic load is given by the expression R*Pa−Pb, where R is a ratio of the cross sectional areas of the two chambers, Pa is the pressure level in one chamber, and Pb is the pressure level in the other chamber.

25. The method as recited in claim 22 further comprising calculating the first threshold level based on pressure of the fluid in the hydraulic system and a characteristic of the actuator.

26. The method as recited in claim 22 wherein the first metering mode is a low side regeneration metering mode, and the second mode is a high side regeneration metering mode.

27. The method as recited in claim 22 wherein the first metering mode is a high side regeneration metering mode, and the second mode is a powered metering mode.

28. The method as recited in claim 22 wherein the first metering mode is a powered metering mode, and the second mode is a low side regeneration metering mode.

29. The method as recited in claim 22 wherein the first metering mode is a low side regeneration metering mode, and the second mode is a powered metering mode.

30. The method as recited in claim 22 wherein the first metering mode is a powered metering mode, and the second mode is a high side regeneration metering mode.

31. The method as recited in claim 22 wherein the first metering mode and the second metering mode are selected from a group consisting of a high side regeneration metering mode and a low side regeneration metering mode.

32. The method as recited in claim 22 wherein, while operating the flow control device in the second metering mode, the first metering mode is selected when the hydraulic load is less than a second threshold which is less than the first threshold.

33. The method recited in claim 22 further comprising selecting a third metering mode when the hydraulic load is greater than a second threshold level that is greater than the first threshold level; and wherein the second metering mode is selected when the hydraulic load is between the first threshold level and the second threshold level.

34. The method as recited in claim 33 wherein:

the first metering mode is a low side regeneration metering mode;

the second metering mode is a high side regeneration metering mode; and the third metering mode is a powered metering mode.

35. The method as recited in claim 22 further comprising, in response to the hydraulic load exceeding a second threshold, changing pressure in a conduit through which fluid is furnished to the hydraulic actuator; wherein the second threshold is less than the first threshold.

36. The method as recited in claim 22 further comprising, in response to the hydraulic load being less than a second threshold, changing pressure in a conduit through which fluid is furnished to the hydraulic actuator, wherein second threshold which is greater than the first threshold.

37. A method of controlling flow of fluid to an actuator in a hydraulic system that has a plurality of metering modes, said method comprising:

determining a hydraulic load which varies with the force acting on the hydraulic actuator;

selecting a first metering mode when the hydraulic load is less than a first threshold level;

selecting a second metering mode when the hydraulic load is treater than the first threshold level;

selecting a third metering mode when the hydraulic load is greater than a second threshold level that is greater than the first threshold level; and operating a flow control device to control flow of fluid to the actuator in response to which one of the plurality of metering modes was selected.

38. A method of controlling flow of fluid to an actuator in a hydraulic system, said method comprising:

determining a hydraulic load which varies with a force acting on the hydraulic actuator;

operating a flow control mechanism in one of a plurality of metering modes to control flow of fluid to the actuator;

calculating a first threshold level based on pressure of the fluid in the hydraulic system and a characteristic of the actuator;

transitioning operation of the flow control mechanism from a second metering mode to a first metering mode when the hydraulic load is less than the first threshold level; and transitioning operation of the flow control mechanism from the first metering mode to the second metering mode when the hydraulic load is greater than a second threshold level, which is greater than the first threshold level.

39. The method as recited in claim 38 wherein the first metering mode and the second metering mode are each selected from a group consisting of powered retraction, powered extension, high side regeneration retraction, high side regeneration extension, low side regeneration retraction, and low side regeneration extension.

40. The method as recited in claim 38 further comprising calculating the first threshold level based on pressure of the fluid in the hydraulic system.

41. The method as recited in claim 38 wherein the first metering mode is a low side regeneration metering mode; and the second metering mode is a high side regeneration metering mode.

42. The method as recited in claim 38 wherein the actuator is connected by the flow control mechanism to a supply line and a return line and the method further comprises:

changing pressure in the supply line to a first level in response to the hydraulic load being less than the first threshold; and changing pressure in the supply line to a second level in response to the hydraulic load being greater than an intermediate threshold which is between the first threshold and the second threshold.

43. The method as recited in claim 42 further comprising:

changing pressure in the return line to a third level in response to the hydraulic load being less than the intermediate threshold; and changing pressure in the return line to a fourth level in response to the hydraulic load being greater than the second threshold.

44. The method as recited in claim 38 wherein the actuator is connected by the flow control mechanism to a return line and the method further comprises:

changing pressure in the return line to a first level in response to the hydraulic load being less than an intermediate threshold, which is between the first threshold and the second threshold; and changing pressure in the return line to a second level in response to the hydraulic load being greater than the second threshold.

45. The method as recited in claim 38 wherein the first metering mode is a high side regeneration metering mode; and the second metering mode is a powered metering mode.

46. The method as recited in claim 45 wherein the actuator is connected by the flow control mechanism to a supply line and a return line and the method further comprises:

changing pressure in the supply line to a first level in response to the hydraulic load being greater than the second threshold; and changing pressure in the supply line to a second level in response to the hydraulic load being less than an intermediate threshold which is between the first threshold and the second threshold.

47. The method as recited in claim 38 wherein the first metering mode is a low side regeneration metering mode; and the second metering mode is a powered metering mode.

48. The method as recited in claim 38 further comprising transitioning operation of the flow control mechanism from the second metering mode to a third metering mode when the hydraulic load is greater than a third threshold level; and transitioning operation of the flow control mechanism from the third metering mode to the second metering mode when the hydraulic load is less than a fourth threshold level, which is less than the third threshold level and greater that the second threshold level.

49. The method as recited in claim 48 further comprising calculating the first threshold level, the second threshold level, the third threshold level, and the fourth threshold level based on pressure of the fluid in the hydraulic system.

50. The method as recited in claim 48 wherein:

the first metering mode is a low side regeneration metering mode;

the second metering mode is a high side regeneration metering mode; and the third metering mode is a powered metering mode.

* * * * *